United States Patent [19]

Dallman

[11] Patent Number: 4,779,601

[45] Date of Patent: Oct. 25, 1988

[54] AUTOMOTIVE FUEL SAVER DEVICE

[76] Inventor: Alfred C. Dallman, 2437 Bending Willow Dr., Dayton, Ohio 45440

[21] Appl. No.: 46,602

[22] Filed: May 7, 1987

[51] Int. Cl.[4] ..... F02M 25/06

[52] U.S. Cl. ..... 123/572; 123/573

[58] Field of Search ..... 123/572, 573, 41.86

[56] References Cited

U.S. PATENT DOCUMENTS

| | | | |
|---|---|---|---|
| 1,286,930 | 12/1918 | Buckner | 123/574 |
| 1,299,790 | 4/1919 | Scott | 123/556 |
| 2,271,150 | 1/1942 | Dressler | 123/41.86 |
| 2,971,505 | 2/1961 | Fortney | 123/572 |
| 2,991,775 | 7/1961 | Schrader | 123/572 |
| 3,630,182 | 12/1971 | Grainger | 123/556 |
| 3,990,421 | 11/1976 | Grainger | 123/556 |
| 4,090,477 | 5/1978 | Gockel | 123/572 |
| 4,269,607 | 5/1981 | Walker | 123/573 |
| 4,279,236 | 7/1981 | Dallman | 123/573 |
| 4,404,950 | 9/1983 | Dallman | 123/572 |
| 4,453,525 | 6/1984 | DeBruler | 123/573 |
| 4,515,137 | 5/1985 | Manolis | 123/572 |
| 4,570,603 | 2/1986 | Piedrafita | 123/570 |

OTHER PUBLICATIONS

Chilton's Manual, pp. 1382-1385, 1-1972.

P. A. Bennett et al., "Reduction of Air Pollution by Control of Emission from Automotive Crankcases", SAE Report 142A, SAE Annual Meeting (Jan. 1960).

*Primary Examiner*—Willis R. Wolfe

*Assistant Examiner*—M. Macy

*Attorney, Agent, or Firm*—Donald J. Singer; Bobby D. Scearce

[57] ABSTRACT

A system for withdrawing vapors from the crankcase of an internal combustion engine and directing the vapors into the air intake manifold thereof for combustion within the engine is described which comprises a first vapor flow circuit interconnecting the crankcase in vapor flow communication with the air intake manifold at a region thereof where a vacuum is generated or maintained, the first circuit including in a described embodiment, an orifice and expansion chamber for expanding and cooling the vapors to an aerosol state; a second vapor flow circuit of generally lower flow impedance than that of the first circuit may be included on certain engine-fuel/air system types for interconnecting the crankcase in vapor flow communication with the air cleaner of the fuel/air system for conducting vapor to the carburetor at high throttle operating conditions.

14 Claims, 2 Drawing Sheets

AUTOMOTIVE FUEL SAVER DEVICE

RIGHTS OF THE GOVERNMENT

The invention described herein may be manufactured and used by or for the Government of the United States for all governmental purposes without the payment of any royalty.

BACKGROUND OF THE INVENTION

The present invention relates generally to utilization of crankcase vapors in internal combustion engines, and more particularly to an improved automotive fuel saving system which utilizes such vapors.

Existing systems for circulating crankcase vapors into the air and fuel intake system of an internal combustion engine include that described in U.S. Pat. No. 3,677,240 to Sarto, as well as those of U.S. Pat. No. 1,286,930 to Buckner and U.S. Pat. No. 1,299,790 to Scott. Background material and descriptions of these and other known systems are given in U.S. Pat. No. 4,279,236 (hereinafter "the '236 system") and U.S. Pat. No. 4,404,950 (hereinafter "the '950 system") to the present inventor, the background and teachings of which patents are incorporated herein by reference.

Crankcase vapors generated in the operation of an internal combustion engine comprise two major components, viz., blowby gases including a carbureted mixture plus exhaust gases passing by the piston rings and entrained particles and other matter of the crankcase lubricating oils which are vaporized by engine heat and agitation. The blowby gases contain water vapor and include large amounts of hydrocarbons and carbon monoxide having high fuel content. Vaporized crankcase lubricating oil often contains relatively large and heavy particulates which are not readily combustible in the engine considering the extremely short burn time for fuel within a cylinder.

The '236 system includes three air flow circuits for handling crankcase vapors. In a first air flow circuit, ram air captured by an air scoop and cooperating with an aspirator draws crankcase vapors from the crankcase and conducts them to the carburetor of the engine. Heavy particulate matter in the vapors is separated, heated and vaporized in a portion of the first circuit disposed in heat exchange relationship with an exhaust manifold of the engine. A second aspirator in the first circuit draws vaporized particulate matter into the first circuit. Vapors mixed with incoming ram air are then directed into the carburetor through the air cleaner cover. A second circuit feeds ventilation air captured by another air scoop into the crankcase and carburetor air cleaner cover to achieve continuous circulation of air through the crankcase and ventilation of vapor therefrom. The '950 system improved on the '236 system by including a belt driven air pump replacing the air scoops of the '236 system. A third air flow circuit in each system adds air to the carburetor to avoid an overly rich fuel/air mixture in the caburetor. The '236 and '950 systems demonstrated improved fuel economy and large reduction in emissions of hydrocarbons (HC) and carbon monoxide (CO). However, characteristics of bleed air type systems, the '236 and '950 systems were characterized by undesirable increase in nitrogen oxides ($NO_x$) emissions.

The present invention provides a substantially improved system for withdrawing vapor from the crankcase of an internal combustion engine, expanding and cooling the vapor to an aerosol state, and inserting the aerosol in to the carburetor of the engine. The aerosol is inserted at any region of the carburetor where a vacuum is generated or maintained, such as at the crankcase ventilation (CV) port, to improve performance and fuel efficiency of the engine. The insertion of crankcase vapors as aerosols into the engine may slow the burn rate of fuel in the cylinders and correspondingly effectively increase the octane rating of the fuel. Tests on a demonstration system indicated at 10–15% increase in fuel economy, improved engine performance and substantial reduction in hydrocarbon, CO and $NO_x$ engine exhaust emissions are compared to the engine without the improvement of the invention.

In accordance with the invention, a first vapor flow circuit interconnects the valve cover, such as at the crankcase vapor port, and the carburetor, such as at the CV vapor port on the carburetor below the throttle plate, to aspirate vapor from the crankcase at high manifold vacuum levels associated with engine operation at medium throttle to curb idle conditions; the first circuit includes means to expand and cool the vapor to an aerosol state prior to insertion into the carburetor which means may comprise an orifice and expansion chamber. A second vapor flow circuit connects the valve cover with the air cleaner cover to promote vapor flow from the valve cover at low to zero manifold vacuum associated with engine operation at medium to wide open throttle conditions. In certain fuel/air supply systems, a vacuum is maintained at substantially all throttle conditions which can be utilized by the invention to draw vapor from the crankcase at all engine operating conditions; for these systems no second circuit is required. No forced air circulation through the system is required.

The discussion herein presented emphasizes the utilization of the invention on gasoline powered, spark ignition engines, which engine type was used in demonstration of the invention. It is asserted, however, that the invention is applicable to other engine types, such as a Diesel, by modification of the invention by one with skill in the field of the invention guided by these teachings.

It is, therefore, a principal object of the invention to provide a system for fuel efficient utilization of crankcase vapors in an internal combustion engine.

It is a further object of the invention to provide an improved fuel efficient fuel/air supply system for an internal combustion engine.

It is yet a further object of the invention to provide a fuel efficient internal combustion engine.

It is yet another object of the invention to provide a system for fuel efficient utilization of crankcase vapors in a fuel injected internal combustion, spark ignition gasoline engine.

It is another object of the invention to provide an improved full scale fuel efficient carburetion system for an internal combustion, spark ignition gasoline engine.

These and other objects of the invention will become apparent as the description of representative embodiments proceeds.

SUMMARY OF THE INVENTION

In accordance with the foregoing principles and objects of the invention, a system for withdrawing vapors from the crankcase of an internal combustion engine and directing the vapors into the air intake manifold thereof for combustion within the engine is described which comprises a first vapor flow circuit interconnecting the crankcase in vapor flow communication with the air intake manifold at a region thereof where a vacuum is generated or maintained, the first circuit including means such as an orifice and expansion chamber for expanding and cooling the vapors to an aerosol state; a second vapor flow circuit of generally lower flow impedence than that of the first circuit may be included on certain engine-fuel/air system types for interconnecting the crankcase in vapor flow communication with the air cleaner of the fuel/air system for conducting vapor to the carburetor at high throttle operating conditions.

DESCRIPTION OF THE DRAWINGS

The invention will be clearly understood from the following detailed description of representative embodiments thereof read in conjunction with the accompanying drawings wherein.

DETAILED DESCRIPTION

Figure 1:
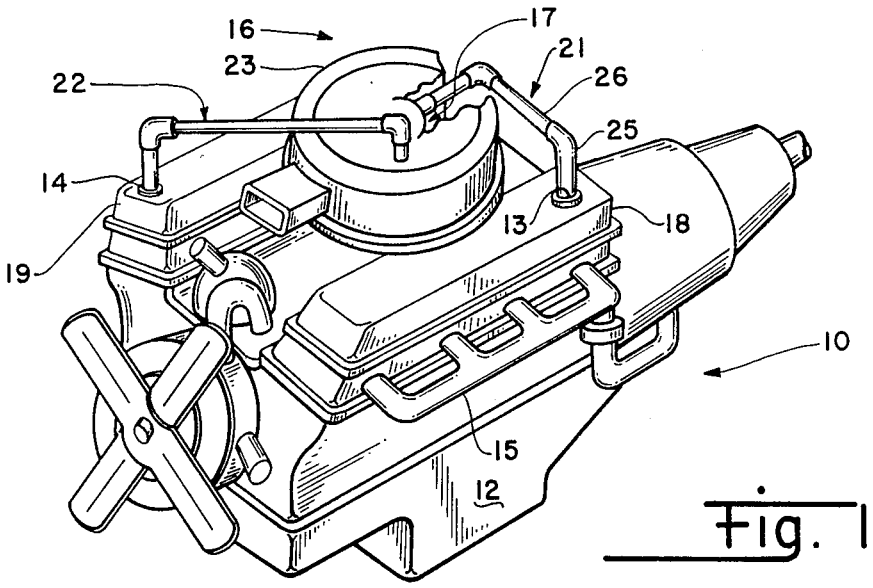
FIG. 1 is a perspective view of an internal combustion engine fitted with the fuel saver system according to the invention.

Referring to FIG. 1, shown therein is a perspective view of a conventional V-8 type gasoline powered internal combustion engine 10 fitted with an automotive fuel saver system of the invention. Although the discussion herein and the figures are directed to and depict a gasoline powered V-8 engine, it is understood that the invention is adaptable to other gasoline engine types, including V-6 and V-4, and engines with in-line configurations of any plurality of cylinders, and to Diesel engines, as would occur to one with skill in the field of the invention guided by these teachings. Engine 10 typically includes a substantially sealed crankcase 12 containing lubricating oil with a first port 13 (specifically the PCV port which may be disposed either in a valve cover or the crankcase body, depending on engine type) and a second (crankcase ventilation input) port 14, exhaust manifold 15, and air/fuel intake (carburetor) system 16. Air/fuel intake system 16 may be of any conventional type used on internal combustion engines of the spark or compression ignited type, and includes an air inlet/air cleaner and a fuel/air carbureting and throttling system mounted to an air intake manifold 17. Ports 13,14 may be provided in different valve covers 18,19, as is preferable in V type engines, or both ports 13,14 may be provided in a single valve cover (e.g., in the Chrysler slant-6 or other in-line engines), in order to accommodate an EPA required crankcase ventilation system for recirculating crankcase vapor through the engine.

The fuel saver system of the invention comprises one or two separate vapor flow circuits for withdrawing from crankcase 12 through ports 13,14 for burning in engine 10, depending on engine and carburetor type. A first circuit 21 aspirates vapor through port 13 and conducts the vapor to intake manifold 17 of air/fuel intake system 16; circuit 21 is described in more detail below in relation to FIGS. 2 and 3. A second circuit 22 may be included in certain engine types for conducting vapor from crankcase 12 through port 14 to the air inlet portion (air cleaner 23) of air/fuel intake system 16; circuit 22 is described in more detail below in relation to FIG. 4.

Figure 2:
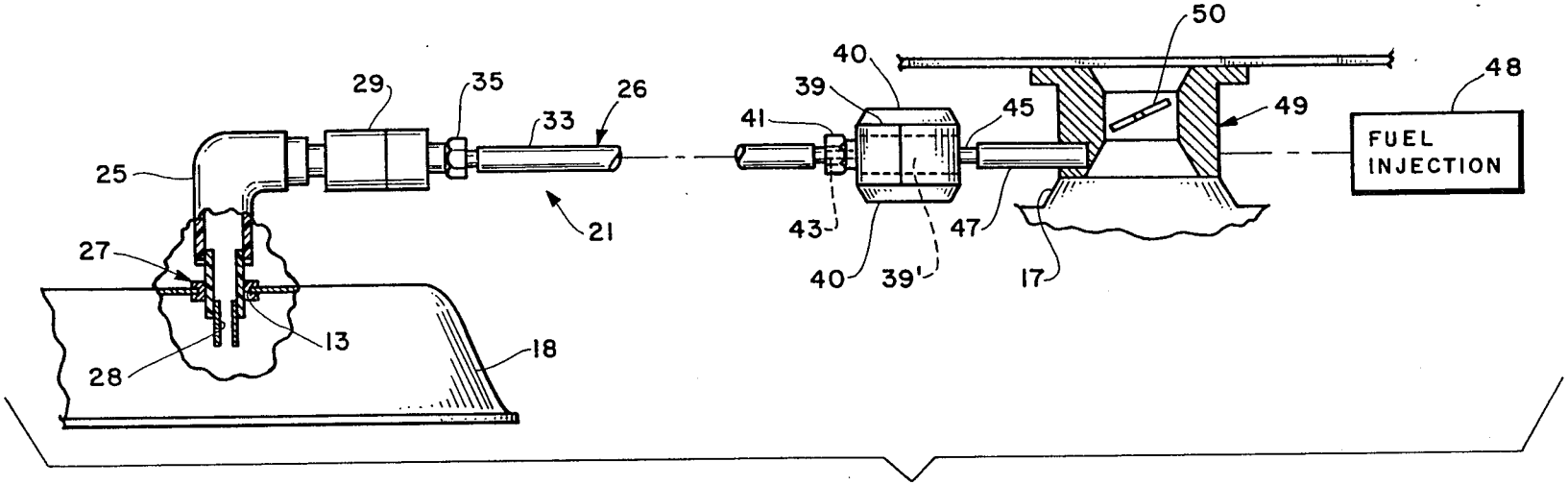
FIG. 2 is a schematic elevational view of a first vapor flow circuit of the invention which interconnects a valve cover and carburetor of the engine.
Figure 3:
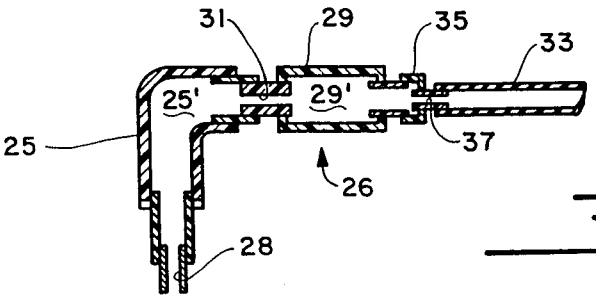
FIG. 3 is a view along line A—A of the circuit of FIG. 2.

Referring now to FIGS. 2 and 3 in conjunction with FIG. 1, and in accordance with a governing principle of the invention, circuit 21 includes means to expand and cool vapors drawn from crankcase 12 to an aerosol state prior to insertion into air/fuel intake system 16. Crankcase vapors may include several constituents (vaporized fuel and oil, CO, $H_2O$, etc), having respective characteristic condensation temperatures. It is advantageous to expand and cool the fuel constituent vapor to an aerosol of fuel droplets or mist suspended in the remaining uncondensed vapor. Accordingly, in an embodiment of the invention, circuit 21 defines a conduit 26 having inlet means connecting to valve cover 18 and outlet means connecting to intake manifold 17, and further includes one or more orifices and expansion chambers. A first expansion chamber 25 may be operatively attached to valve cover 18 at port 13 through an appropriate fitting 27, which may also function to define a first orifice for vapor expansion within the circuit 21 as discussed below. Chamber 25 is disposed above valve cover 18 to serve as an expansion chamber, a trap for suspended particulate matter in the crankcase vapor, and a condensate region for oil vapor.

A second expansion chamber 29 may be disposed adjacent chamber 25 with orifice 31 therebetween. Hose 33 of appropriate length is connected at a first end to chamber 29 through nipple 35 or like connector defining orifice 37 through which chamber 29 and hose 33 communicate. The second end of hose 33 is connected to a third expansion chamber 39 through nipple 41 or like connector defining orifice 43. Nipple 45 connects chamber 39 to CV port 47 of carburetor 49 of air/fuel intake system 16 through a short piece of (nominally $\frac{3}{8}$ inch ID) hose just below throttle plate 50. Chamber 39 is preferably located as closely as practicable to CV port 47.

Chambers 25,29,39 may comprise any suitable material and shape defining expansion regions 25',29',39' (FIGS. 2 and 3) of selected size. In a system built in demonstration of the invention, chambers 25,29 comprised $\frac{3}{4}$ inch ID fittings and/or tube sections of PCV about $2\frac{1}{2}$ to 3 inches long. PVC was selected for chambers 25,29 to provide sufficient heat insulation between engine 10 and vapor aspirated from crankcase 12 so that the vapors within chambers 25,29 may expand and cool either adiabatically or by heat transfer to an aerosol state. Chamber 39 may be metallic (e.g., comprising a copper fitting) to conduct heat away from the vapor for further cooling thereof to an aerosol state. Heat rejection may be further facilitated by including cooling fins 40 on the outer surface of chamber 39. Hose 33 is normally about $\frac{3}{8}$ inch ID by about 12 to 25 inches long rubber hose for most engines utilizing the invention. Orifices 31,37,43 are of appropriate size to promote vapor expansion and cooling, and were sized at about 3/16 inch in the demonstration system, i.e., the cross-sectional area of each expansion region 25',29',39' defined by chambers 25,29,39 was about 16 times that of each orifice 31,37,43. The orifice defined by inlet 28 at fitting 27 was about $\frac{1}{4}$ inch.

In the operation of engine 10 generally at idle to about half throttle, a vacuum is generated below the throttle plate 50 of carburetor 49 at about 15 to 24 inches of water, which vacuum, acting on circuit 21 and cooperating with pressure within crankcase 12 draws vapor from crankcase 12 to carburetor 49. In engines having fuel injection means 48, a vacuum is generated by a venturi located seriatim in the air supply conduit in a TBI (throttle body injection) system, or in a multiport fuel injection system.

Application of the general gas law to the structure of circuit 21 shows that the temperature within successive expansion chambers 25,29,39 decreases with reduced pressure therein approximately as:

$$T_2 = P_2 T_1 / P_1$$

where $T_1$,$P_1$ and $T_2$,$P_2$ are vapor temperatures and pressures within two successive expansion chambers.

The volume of a petroleum fuel increases by a factor of about 140 when it is completely changed from a liquid to a gas at constant ambient pressure. Therefore, since crankcase vapors are about 85% carbureted mixture (ref, "Reduction of Air Pollution by Control of Emission from Automotive Crankcases", by P. A. Bennett et al, SAE Report 142A, SAE Annular Meeting, (January 1960)), the fuel vapor concentration is maximized when maintained in a total aerosol state or as close thereto as practicable.

Converting hot crankcase vapor to a lower temperature aerosol by expansion within circuit 21 as just described substantially reduces the volume occupied by the crankcase vapor, i.e., the vapor occupies substantially less volume in the aerosol state, which is a controlling consideration in the operation of the invention. If crankcase vapors reach the cylinders of engine 10 as an aerosol, some cooling effect occurs and improvement in characteristics of the flame front representative of fuel combustion within the cylinders necessarily results, fuel burn rate is retarded, and effective overall fuel octane rating is increased. Vehicle test results indicate both improved fuel economy and decreased emissions utilizing the system of the invention, which benefits are best explained by the aerosols generated by the invention modifying the flame front of the ignited fuel/air mixture by providing more orderly progression of the front within the cylinders of the engine.

Figure 4:
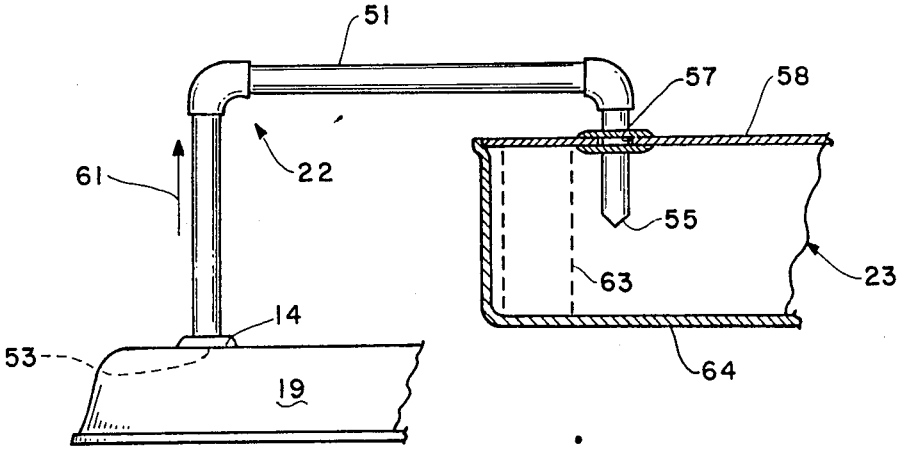
FIG. 4 is a schematic elevational view of a second vapor flow circuit of the invention which interconnects a valve cover and the air cleaner of the carburetor.

Referring now to FIG. 4, shown therein is a detailed schematic elevational view of circuit 22 of FIG. 1. Circuit 22 comprises a conduit 51 of suitable length and configuration and having inlet 53 at port 14 in valve cover 19 and outlet 55 at inlet 57 in cover 58 of air cleaner 23. Conduit 51, if included, is configured to present lesser flow impedance to vapor than does circuit 21, and, accordingly, comprises a conduit of inner diameter generally larger than that of hose 33 of circuit 21. In the demonstration system, conduit 51 was about ½ inch ID tubing. Outlet 55 of conduit 51 is shown in FIG. 4 communicating with the interior of air cleaner 23 in the preferable location within air filter 63 (usually annularly shaped) and off center of air cleaner 23 away from the throat of carburetor 49 so that suspended particulate matter within the vapor preferentially drops onto floor 64 of air cleaner 23 instead of entering carburetor 49. Inlet 57 is shown in cover 58, although connection of conduit 51 to air cleaner 23 may be otherwise made to floor 64 of air cleaner 23 to limit passage of particulate matter into carburetor 49.

In the operation of the fuel saver system of the invention, circuit 21, operating under the influence of the manifold vacuum characteristic of medium throttle or engine idle conditions, draws crankcase vapor from valve cover 18 and expands and cools the vapor in an aerosol state for insertion into carburetor 49 as shown in FIG. 2. For certain engines operating at high throttle conditions, manifold vacuum within the carburetor approaches zero and crankcase pressure increases with engine rpm and engine torque load (to a pressure level above ambient pressure). At the low vacuum conditions associated with wide open throttle (WOT) operation, flow within circuit 21 substantially ceases and vapor flow commences through the lesser impeded path in the direction of arrow 61 through circuit 22. Under normal throttle conditions, that is at less than WOT, there is little or no flow in circuit 22, and, near a closed throttle condition, there is some flow in a direction opposite to arrow 61. Circuits 21,22 therefore cooperate to optimize crankcase vapor combustion at all engine operating conditions. It is noted, however, that in certain engine/carburetor types, such as those having fuel injection, vacuum is maintained by a venturi located seriatim in the air supply conduit to the carburetor at all throttle conditions, which can be utilized by the invention to draw vapor from the crankcase at all engine operation conditions, and circuit 22 will thereby be omitted in these cases.

The invention described herein does not require modification of engine tuning procedures for minimum air pollution. The procedures and adjustments to produce a leanburn engine may be used with the invention as with conventional crankcase ventilation systems. The release of harmful emissions from the engine is substantially reduced and both fuel economy and engine performance are improved as a result of improved utilization of the crankcase vapor.

The invention accomplishes its objectives in a system simpler but more scientific than the '236 system, the '950 system, or other factory installed prior art crankcase ventilation systems. Installation time for the invention is substantially shorter than with the '950 system, and reliability and durability of the system of the invention is markedly better.

The invention therefore provides a crankcase ventilating system for improving fuel economy in an internal combustion engine. It is understood that certain modifications to the invention may be made as might occur to one skilled in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A system for withdrawing vapors from the crankcase of an internal combustion engine and conducting said vapors into the fuel/air supply system of said engine for combustion within a combustion region of said engine, comprising:

(a) a first conduit for interconnecting said crankcase in vapor flow communication with the fuel/air supply system of said engine, said first conduit having means defining an inlet at a first end thereof for operative connection to said crankcase and means defining an outlet at a second end thereof for operative connection to the fuel intake manifold of said fuel/air supply system, whereby vapors are drawn from said crankcase through said first conduit by action of a partial vacuum generated within said fuel intake manifold during operation of said engine;

(b) said first conduit including near said inlet means defining a condensate chamber disposed generally above said inlet for trapping oil and particulate matter passing with said vapors from said crankcase and for allowing said oil and particulate matter so trapped to fall by gravity back into said crankcase; and (c) means defined along said first conduit between said condensate chamber and said outlet for simultaneously expanding and cooling said vapors substantially to an aerosol state during passage of said vapors through said first conduit from said crankcase to said fuel intake manifold of said fuel/air supply system.

2. The system of claim 1 wherein said means for expanding and cooling said vapors includes an expansion chamber and a first orifice of first preselected size defined along said first conduit, said first orifice disposed adjacent said expansion chamber and along said first conduit between said condensate chamber and said expansion chamber, said expansion chamber being substantially larger in cross section than said first orifice, whereby said vapors are substantially converted to the aerosol state by expansion through said first orifice into said expansion chamber upon passage of said vapors through said first conduit from said crankcase to said fuel intake manifold of said fuel/air supply system.

3. The system of claim 2 wherein the ratio of the cross sectional area of said expansion chamber to the cross sectional area of said first orifice is about 16.

4. The system of claim 1 further comprising a second conduit for interconnecting said crankcase in vapor flow communication with said fuel/air supply system, said second conduit having means defining an inlet at a first end thereof for operative connection to said crankcase and means defining an outlet at a second end thereof for operative connection to the air inlet of said fuel/air supply system, said second conduit having impedance to vapor flow generally smaller than that of said first conduit.

5. A system for withdrawing vapors from the crankcase of an internal combustion engine and conducting said vapors into the fuel/air supply system of said engine for combustion within a combustion region of said engine, comprising:

(a) a first conduit for interconnecting said crankcase in vapor flow communication with said fuel/air supply system of said engine, said first conduit having means defining an inlet at a first end thereof for operative connection to said crankcase and means defining an outlet at a second end thereof for operative connection to a fuel intake manifold of said fuel/air supply system, whereby vapors are drawn from said crankcase through said first conduit by action of a partial vacuum generated within said fuel intake manifold during operation of said engine;

(b) a second conduit for interconnecting said crankcase in vapor flow communication with said fuel/air supply system, said second conduit having means defining an inlet at a first end thereof for operative connection to said crankcase and means defining an outlet at a second end thereof for operative connection to the air inlet of said fuel/air supply system; and (c) said first conduit including means for simultaneously expanding and cooling said vapors substantially to an aerosol state during passage of said vapors through said first conduit from said crankcase to said fuel intake manifold of said fuel/air supply system, said means including a condensate chamber disposed generally above said first conduit inlet for trapping oil and particulate matter from said crankcase and for allowing said oil and particulate matter so trapped to fall by gravity back into said crankcase.

6. The system of claim 5 wherein said means for expanding and cooling said vapors includes first and second expansion chambers and first and second orifice of respective preselected first and second sizes defined within said first conduit, said first expansion chamber disposed near and generally above said inlet of said first conduit for trapping oil and particulate matter passing with said vapors from said crankcase and said second expansion chamber disposed near said outlet of said first conduit, said first orifice disposed adjacent said first expansion chamber between said inlet of said first conduit and said first expansion chamber and said second orifice disposed adjacent said second expansion chamber between said first expansion chamber and said second expansion chamber, said second expansion chamber being substantially larger in cross section than said second orifice, whereby said vapor is substantially converted to the aerosol state by simultaneous cooling and expansion of said vapors through said first orifice into said first expansion chamber and through said second orifice into said second expansion chamber upon passage of said vapors through said first conduit from said crankcase to said fuel intake manifold of said fuel/air supply system.

7. The system of claim 6 wherein the ratio of the cross sectional area of said second expansion chamber to the cross sectional area of said second orifice is about 16.

8. In an internal combustion engine having a substantially sealed crankcase and a fuel/air supply system including a throttle plate, an air inlet and fuel injection means, said engine including a system for withdrawing vapors from said crankcase and inserting said vapors into said fuel/air supply system for combustion within a combustion region of said engine, an improvement comprising:

(a) a conduit interconnecting said crankcase in vapor flow communication with said fuel/air supply system, said conduit having means defining an inlet at a first end thereof operatively connected to said crankcase and means defining an outlet at a second end thereof operatively connected to the fuel intake manifold of said fuel/air supply system, whereby vapors are drawn from said crankcase through said conduit by action of a partial vacuum generated within said fuel intake manifold during operation of said engine;

(b) said conduit including near said inlet means defining a condensate chamber disposed generally above said inlet for trapping oil and particulate matter passing with said vapors from said crankcase and for allowing said oil and particulate matter so trapped to fall by gravity back into said crankcase; and (c) means defined along said conduit between said condensate chamber and said outlet for simultaneously expanding and cooling said vapors substantially to an aerosol state during passage of said vapors through said conduit from said crankcase to said fuel intake manifold of said fuel/air supply system.

9. The engine of claim 8 wherein said means for simultaneously expanding and cooling said vapors includes an expansion chamber and a first orifice of preselected first size defined along said conduit, said first orifice disposed adjacent said expansion chamber and along said conduit between said condensate chamber and said expansion chamber, all expansion chamber being substantially larger in cross section than said first orifice, whereby said vapors are substantially converted to the aerosol state by expansion through said first orifice into said expansion chamber.

10. The engine of claim 9 wherein the ratio of the cross sectional area of said expansion chamber to the cross sectional area of said first orifice is about 16.

11. In a gasoline powered internal combustion engine having a substantially sealed crankcase and an air intake manifold including a throttle plate and an air inlet, said engine including a system for withdrawing vapors from said crankcase and inserting said vapors into said intake manifold for combustion within a combustion region of said engine, an improvement comprising:

(a) a first conduit interconnecting said crankcase in vapor flow communication with said intake manifold, said first conduit having means defining an inlet at a first end thereof operatively connected to said crankcase and means defining an outlet at a second end thereof operatively connected to said intake manifold, whereby vapors are drawn from said crankcase through said first conduit by action of a partial vacuum generated within said intake manifold during operation of said engine;

(b) a second conduit interconnecting said crankcase in vapor flow communication with said intake manifold, said second conduit having means defining an inlet at a first end thereof operatively connected to said crankcase and means defining an outlet at a second end thereof operatively connected to the air inlet of said intake manifold; and (c) means along said first conduit defining first and second expansion chambers and first and second orifices of respective preselected first and second sizes defined within said first conduit, said first expansion chamber disposed near and generally above said inlet of said first conduit for trapping oil and particulate matter passing with said vapors from said crankcase and for allowing said oil and particulate matter so trapped to fall by gravity back into said crankcase, and said second expansion chamber disposed near said outlet of said first conduit, said first orifice disposed adjacent said first expansion chamber between said inlet of said first conduit and said first expansion chamber and said second orifice disposed adjacent said second expansion chamber between said first expansion chamber and said second expansion chamber, and second expansion chamber being substantially larger in cross section than said second orifice, whereby said vapor is substantially converted to the aerosol state by simultaneous cooling and expansion of said vapors through said first orifice into said first expansion chamber and through said second orifice into said second expansion chamber upon passage of said vapors through said first conduit from said crankcase to said intake manifold.

12. The engine of claim 11 wherein the ratio of the cross sectional area of said second expansion chamber to the cross sectional area of said second orifice is about 16.

13. The system of claim 2 further comprising means defining a second orifice of preselected second size near said inlet and between said inlet and said condensate chamber.

14. The engine of claim 9 further comprising means defining a second orifice of preselected second size near said inlet and between said inlet and said condensate chamber.

* * * * *